US010077781B2

(12) United States Patent
Irie et al.

(10) Patent No.: US 10,077,781 B2
(45) Date of Patent: Sep. 18, 2018

(54) ELECTRIC PUMP HAVING PLASTIC CIRCUIT HOUSING

(71) Applicant: ASMO CO., LTD., Shizuoka-ken (JP)

(72) Inventors: Masaru Irie, Shizuoka (JP); Toshihiro Matsuura, Hamamatsu (JP); Hiroki Ozaki, Gamagori (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/639,728

(22) Filed: Jun. 30, 2017

(65) Prior Publication Data

US 2017/0298941 A1 Oct. 19, 2017

Related U.S. Application Data

(62) Division of application No. 13/738,702, filed on Jan. 10, 2013, now abandoned.

(30) Foreign Application Priority Data

Jan. 17, 2012 (JP) ..... 2012-007363
Sep. 20, 2012 (JP) ..... 2012-207333

(51) Int. Cl.
*F04D 29/02* (2006.01)
*F04D 29/58* (2006.01)
(Continued)

(52) U.S. Cl.
CPC ..... *F04D 29/026* (2013.01); *F04C 2/10* (2013.01); *F04D 13/06* (2013.01);
(Continued)

(58) Field of Classification Search
CPC ..... F04D 13/0613; F04D 29/02
See application file for complete search history.

(56) References Cited

U.S. PATENT DOCUMENTS 5,083,052 A * 1/1992 Ochi ..... H02K 1/187 29/598
5,119,071 A * 6/1992 Takezawa ..... F04B 49/06 318/130
(Continued)

FOREIGN PATENT DOCUMENTS

JP 2005-337025 A 12/2005
JP 2006-105102 A 4/2006
(Continued)

OTHER PUBLICATIONS

MachineTranslationJP201132982, Patent Translate, EPO.org Mar. 24, 2017, pp. 1-19.*

*Primary Examiner* — Bryan Lettman
*Assistant Examiner* — Timothy P Solak
(74) *Attorney, Agent, or Firm* — Christensen, Fonder, Dardi & Herbert PLLC

(57) ABSTRACT

A metal pump housing includes a shaft support hole for supporting a middle part of a rotary shaft. The rotary shaft includes a first end on which a pump operating portion is provided and a second end on which a motor rotor is provided. A metal motor case is fixed to a part of the pump housing that is at a side of the second end. The motor case accommodates a motor section including a motor stator and a motor rotor. A plastic circuit case member is fixed to a part of the motor case that is opposite to the part to which the pump housing is fixed. A circuit substrate for controlling the motor section is fixed to the circuit case member and is separate from the motor case.

14 Claims, 8 Drawing Sheets

(51) Int. Cl.
*F04D 13/06* (2006.01)
*F04C 2/10* (2006.01)

(52) U.S. Cl.
CPC ..... *F04D 29/5806* (2013.01); *F04D 29/588* (2013.01); *F04D 29/5813* (2013.01); *F04D 29/5893* (2013.01)

(56) References Cited

U.S. PATENT DOCUMENTS

| | | | | |
|---|---|---|---|---|
| 5,708,726 | A | 1/1998 | Brinkley et al. | |
| 5,957,547 | A | 9/1999 | Schliebe et al. | |
| 5,969,445 | A * | 10/1999 | Horiuchi | H02K 11/40 310/64 |
| 7,036,892 | B2 * | 5/2006 | Suzuki | F04C 2/102 303/116.4 |
| 2004/0037719 | A1 | 2/2004 | Sunaga et al. | |
| 2004/0109772 | A1 | 6/2004 | Ogawa et al. | |
| 2007/0228824 | A1 | 10/2007 | Yasukawa et al. | |
| 2007/0251473 | A1 * | 11/2007 | Schafer | F01L 1/022 123/90.11 |
| 2009/0041598 | A1 | 2/2009 | Saito et al. | |
| 2009/0104055 | A1 | 4/2009 | Satou et al. | |
| 2009/0152967 | A1 | 6/2009 | Sahara et al. | |
| 2009/0269222 | A1 | 10/2009 | Fukasaku et al. | |
| 2010/0008797 | A1 | 1/2010 | Yukitake | |
| 2011/0103979 | A1 | 5/2011 | Taguchi et al. | |

FOREIGN PATENT DOCUMENTS

| | | | | |
|---|---|---|---|---|
| JP | 2006-274921 | A | 10/2006 | |
| JP | 2006-274922 | A | 10/2006 | |
| JP | 2006-274968 | A | 10/2006 | |
| JP | 2007-092691 | A | 4/2007 | |
| JP | 2007-278311 | A | 10/2007 | |
| JP | 4042050 | B2 | 11/2007 | |
| JP | 2008-092759 | A | 4/2008 | |
| JP | 2009-232554 | A | 10/2009 | |
| JP | 2010-007516 | A | 1/2010 | |
| JP | 2011-32982 | * | 2/2011 | F04C 2/10 |
| JP | 2011-032982 | A | 2/2011 | |
| JP | 2011-094553 | A | 5/2011 | |

* cited by examiner

ELECTRIC PUMP HAVING PLASTIC CIRCUIT HOUSING

CROSS-REFERENCE TO RELATED APPLICATIONS

The present application is a divisional application of U.S. patent application Ser. No. 13/738,702, filed Jan. 10, 2013, now abandoned, which claims priority to Japanese Patent Application No. 2012-007363, filed Jan. 17, 2012 and Japanese Patent Application No. 2012-207333, filed Sep. 20, 2012, the disclosures of which are hereby incorporated by reference herein in their entireties.

BACKGROUND OF THE INVENTION

The present invention relates to an electric pump that draws in and discharges fluid such as oil.

Conventionally, electric pumps as disclosed in Japanese Patent No. 4042050 have been proposed. The electric pump includes a metal pump housing, which has a shaft support hole for rotationally supporting a middle part of a rotary shaft, and a motor case, which is fixed to the pump housing. A motor stator is provided in the motor case, and a motor rotor, which is provided on the end of the rotary shaft, is accommodated inside the motor stator. The motor case is formed of plastic and is insert-molded to cover the motor stator. A mounting portion for mounting a circuit substrate is integrally formed on a part of the motor case that is opposite to the part to which the pump housing is fixed. A circuit substrate that contains circuit components is mounted on the mounting portion, and the circuit substrate and the circuit components are covered by a cover fixed to the motor case.

However, in the electric pump as above described, heat generated at a motor section including the motor stator and the motor rotor is not easily dissipated by the plastic motor case. Also, since the heat generated at the motor section is directly transferred from the motor case to the circuit substrate, the heat may cause damage on the circuit components. That is, the heat generated at the motor section may be transferred from the mounting portion integrally formed on the motor case directly to the circuit substrate.

SUMMARY

Accordingly, it is an objective of the present invention to provide an electric pump that is less likely to transmit heat of a motor section to a circuit substrate while easily dissipating the heat of the motor section.

In accordance with one aspect of the present disclosure, an electric pump is provided that includes a metal pump housing, a metal motor case, a plastic circuit case member, and a circuit substrate. The metal pump housing includes a shaft support hole for rotationally supporting a middle part of a rotary shaft and a pump chamber component. The rotary shaft includes a first end on which a pump operating portion is provided and a second end on which a motor rotor is provided, and the pump chamber component is configured to define a part of the pump chamber on one end of the shaft support hole. The metal motor case is fixed to the pump housing at a side of the second end. The motor case is configured to accommodate a motor section including a motor stator and a motor rotor inside the motor case. The plastic circuit case member fixed to a part of the motor case that is opposite to the part to which the pump housing is fixed. The circuit substrate contains a circuit component for controlling activation of the motor section. The circuit substrate is fixed to the circuit case member and is separate from the motor case.

According to the above-mentioned configuration, heat generated at the motor section is reliably dissipated from the motor case and the pump housing, which are made of metal. Also, since the circuit substrate fixed to the circuit case member is separate from the motor case, heat of the motor section is not easily transferred from the motor case directly to the circuit substrate. Furthermore, since the circuit case member is made of plastic, heat of the motor case is not easily transferred to the circuit substrate via the circuit case member. Thus, according to the electric pump of the above-mentioned configuration, while easily dissipating heat of the motor section from the motor case and the pump housing, the heat is prevented from being transferred to the circuit substrate. As a result, the circuit component is prevented from being damaged by heat.

According to the above-mentioned configuration, vibration generated at the pump operating portion and the motor section is prevented from being directly transmitted from the motor case to the circuit substrate. As a result, the circuit substrate and the circuit component are prevented from being damaged by vibration.

In accordance with one aspect, the circuit substrate is located inside the motor case.

According to the above-mentioned configuration, the entire length of the electric pump is prevented from being increased while ensuring the length of the motor case required for reliably dissipating heat.

In accordance with one aspect, the electric pump further includes a metal heat sink for dissipating heat of the circuit component, and the circuit case member is arranged between the heat sink and the motor case.

According to the above-mentioned configuration, since the circuit case member formed of plastic is arranged between the motor case and the heat sink, heat generated in the motor section is easily transferred to the metal pump housing and not easily transferred to the heat sink. Thus, the heat sink can be dedicated to dissipating heat generated at the circuit component. Thus, heat of the circuit component is reliably dissipated from the heat sink. As a result, the circuit component is prevented from being damaged by heat.

In accordance with one aspect, the circuit case member retains the circuit substrate in the vicinity of the motor case, and the circuit case member further includes a through hole, which extends in the axial direction of the rotary shaft. Also, the heat sink is provided on the circuit case member to close the through hole.

According to the above-mentioned configuration, the heat sink, which closes the through hole of the circuit case member, is exposed toward the motor case from the circuit case member on which the circuit substrate is retained. Thus, heat generated on the circuit component is efficiently transferred to the heat sink. As a result, heat of the circuit component is efficiently dissipated.

In accordance with one aspect, the heat sink is located inward of the outer shape of the circuit case member as viewed in the axial direction of the rotary shaft.

According to the above configuration, the size of the heat sink, which is made of metal that has a higher specific gravity as compared to plastic, is reduced. Therefore, load such as imposed load that the heat sink applies to the plastic circuit case member is efficiently reduced. Also, since the circuit case member is formed of plastic, deterioration by heat from the motor case is concerned. Thus, reducing the imposed load of the heat sink on the circuit case member is effective in terms of reducing deterioration of the circuit case member.

In accordance with one aspect, the motor stator includes a connecting portion. The circuit substrate includes an introduction bore connected to the connecting portion of the motor stator, and the axis of the introduction bore extends through the through hole of the circuit case member.

According to the above-mentioned configuration, the connection between the introduction bore of the circuit substrate and the coil connecting portion of the motor stator can be visually checked via the through hole of the circuit case member in a state in which the heat sink is not mounted. As a result, operability is improved.

In accordance with one aspect, the circuit case member includes an accommodating recess that recesses in a direction away from the circuit substrate to accommodate the circuit component, and the heat sink is arranged side-by-side with the accommodating recess in a direction orthogonal to the rotary shaft.

According to the above-mentioned configuration, the heat sink is arranged side-by-side with the accommodating recess in a direction orthogonal to the rotary shaft. Thus, the size of the circuit case member is prevented from being increased in the axial direction by providing the heat sink. The configuration contributes to size reduction of the electric pump in the axial direction.

In accordance with one aspect, the heat sink is a heat sink cover, and the heat sink cover and the motor case are fixed to sandwich the circuit case member. Also, a part of the heat sink cover close to the motor case includes a circuit accommodating recess for accommodating the circuit component.

According to the above-mentioned configuration, the circuit component is accommodated in the circuit accommodating recess of the heat sink cover. Thus, heat generated in the circuit component is more reliably dissipated from the heat sink cover. As a result, the circuit component is more reliably prevented from being damaged by heat.

In accordance with one aspect, the electric component includes a large circuit component and a small circuit component, and the large circuit component is larger than the small circuit component. The circuit accommodating recess includes a large recess, which is deep in the axial direction of the rotary shaft to be able to accommodate the large circuit component, and a small recess, which is shallow in the axial direction to be able to accommodate the small circuit component. A dissipation fin is formed on the back surface of the heat sink cover that corresponds to the small recess, the dissipation fin projecting in the axial direction.

According to the above-mentioned configuration, the dissipation fin, which projects in the axial direction, is formed on the back surface of the heat sink cover at a part that corresponds to the small recess. Thus, the dissipation fin is prevented from increasing the entire axial length of the electric pump, and the dissipation fin improves the dissipation performance.

In accordance with one aspect, the small circuit component includes a power transistor for controlling the motor stator, the motor stator is a stator of a brushless motor, and the small recess accommodates the power transistor.

According to the above-mentioned configuration, the power transistor for controlling the motor stator is accommodated in the small recess. Thus, heat from the power transistor that easily generates heat is efficiently dissipated from the dissipation fin, which is formed on the back surface of the small recess.

In accordance with one aspect, the power transistor is mounted on the circuit substrate, and the power transistor contacts a bottom surface of the small recess via an elastic member.

According to the above-mentioned configuration, the power transistor is mounted on the circuit substrate fixed to the circuit case member, and is abutted against the bottom surface of the small recess via an elastic member. Thus, the heat sink cover is prepared without requiring high dimensional accuracy, and heat from the power transistor is more efficiently dissipated from the dissipation fin, which is formed on the back surface of the small recess, via the elastic member.

In accordance with one aspect, the motor stator includes a coil connecting end. The circuit case member includes a guiding and retaining portion for retaining the coil connecting end and guiding the coil connecting end toward the circuit accommodating recess. The motor case and the circuit case member have a retaining structure that prevents movement of the motor case and the circuit case member relative to each other.

According to the above-mentioned configuration, the circuit case member includes the guiding and retaining portion, which retains the coil connecting end of the motor stator, and guides the coil connecting end toward the circuit accommodating recess. The motor case and the circuit case member have a retaining structure that prevents movement relative to each other. Thus, the coil connecting end is arranged in a stable manner facing toward the circuit accommodating recess. If the structure does not include the guiding and retaining groove nor the retaining structure, the coil connecting end can move freely and undesirably deform. In this case, it is difficult to improve the reliability of the connection between the coil connecting end and the circuit substrate, which is fixed to the circuit case member. However, the above-mentioned configuration improves such connection reliability.

In accordance with one aspect, the circuit case member is formed of a flexible plastic material.

According to the above-mentioned configuration, the flexible circuit case member absorbs vibration of the motor case. Thus, the vibration is prevented from being transmitted from the motor stator to the circuit substrate via the circuit case member.

In accordance with one aspect, the circuit substrate is fixed to the circuit case member by thermal staking.

According to the above-described configuration, circuit case member and the circuit substrate are fixed to each other without using a fixing member such as bolts. As a result, the structure is simplified.

In accordance with another aspect of the present disclosure, an electric pump is provided that includes a metal pump housing, a metal stator case, a plastic circuit case member, and a metal heat sink cover. The metal pump housing includes a shaft support hole for rotationally supporting a middle part of a rotary shaft and a pump chamber component. The rotary shaft includes a first end on which a pump operating portion is provided and a second end on which a motor rotor is provided, and the pump chamber component is configured to define a part of the pump chamber on one end of the shaft support hole. The metal stator case is fixed to the pump housing at a side of the second end. The stator case accommodates and fixes a motor stator, and the motor rotor is accommodated inside the motor stator. The plastic circuit case member is fixed to a part of the motor case that is opposite to the part to which the pump housing is fixed. The heat sink cover and the stator case are fixed to sandwich the circuit case member, and a part of the heat sink cover that is close to the stator case includes a circuit accommodating recess for accommodating a circuit component.

According to the above-described configuration, heat generated at the motor section including the motor stator and the motor rotor is reliably dissipated from the stator case and the pump housing, which are made of metal. Since the plastic circuit case member is located between the motor section and the heat sink cover, heat of the motor section is not easily transferred to the metal heat sink cover. That is, heat of the motor section is not easily transferred to the circuit accommodating recess. Thus, heat generated at the motor is not easily transferred to the circuit component accommodated in the circuit accommodating recess of the heat sink cover. Also, heat generated at the circuit component is reliably dissipated from the heat sink cover. Thus, the circuit component is prevented from being damaged by heat.

Other aspects and advantages of the disclosure will become apparent from the following description, taken in conjunction with the accompanying drawings, illustrating by way of example the principles of the disclosure.

BRIEF DESCRIPTION OF THE DRAWINGS

The features of the present disclosure that are believed to be novel are set forth with particularity in the appended claims. The disclosure, together with objects and advantages thereof, may best be understood by reference to the following description of the presently preferred embodiments together with the accompanying drawings in which:

DESCRIPTION OF THE PREFERRED EMBODIMENTS

An electric pump for circulating vehicle oil according to a first embodiment of the present invention will be described with reference to FIGS. 1 to 4.

Figure 1:
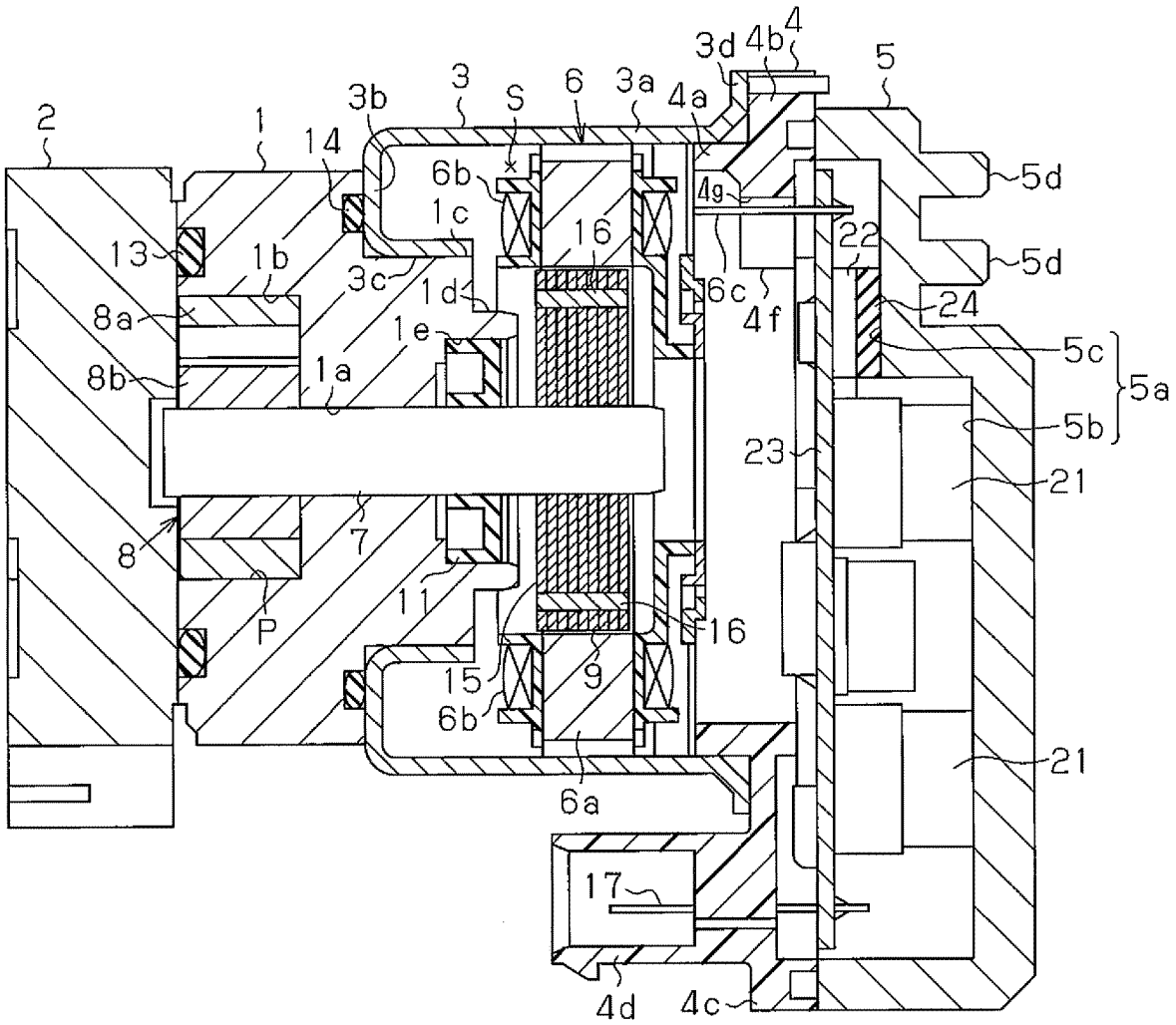
FIG. 1 is a cross-sectional view illustrating an electric pump according to a first embodiment of the present invention.

In FIG. 1, for illustration purposes, the axial direction of the electric pump extends in the left-right direction of FIG. 1. A first end of the electric pump is located on the left side in FIG. 1, and a second end of the electric pump is located on the right side in FIG. 1. A rotary shaft 7 extends in the left-right direction in FIG. 1. The rotary shaft 7 includes a first end located on the left side in FIG. 1, and a second end located on the right side in FIG. 1. That is, a pump end plate 2 is located on the first end of the electric pump and a heat sink cover 5 is located on the second end of the electric pump. In the following description, first ends of members are located on the left side in FIG. 1, and second ends are located on the right side in FIG. 1.

As shown in FIG. 1, the electric pump includes a pump housing 1 and the pump end plate 2, which is located on the left side of the pump housing 1 in FIG. 1. Furthermore, the electric pump includes a motor case, which is a stator case 3 in the first embodiment, located on the right side of the pump housing 1 in FIG. 1, a circuit case member 4, which is located on the right side of the stator case 3, and the heat sink cover 5, which is located on the right side of the circuit case member 4. These components form the entire housing of the electric pump. The electric pump accommodates a motor stator 6 and the rotary shaft 7, which is located in the motor stator 6. Furthermore, the electric pump accommodates a pump operating portion, which is a pump rotor 8 in the first embodiment mounted on the first end of the rotary shaft 7, a motor rotor 9, which is mounted on the second end of the rotary shaft 7, and later-described circuit components located in the heat sink cover 5.

Figure 2:
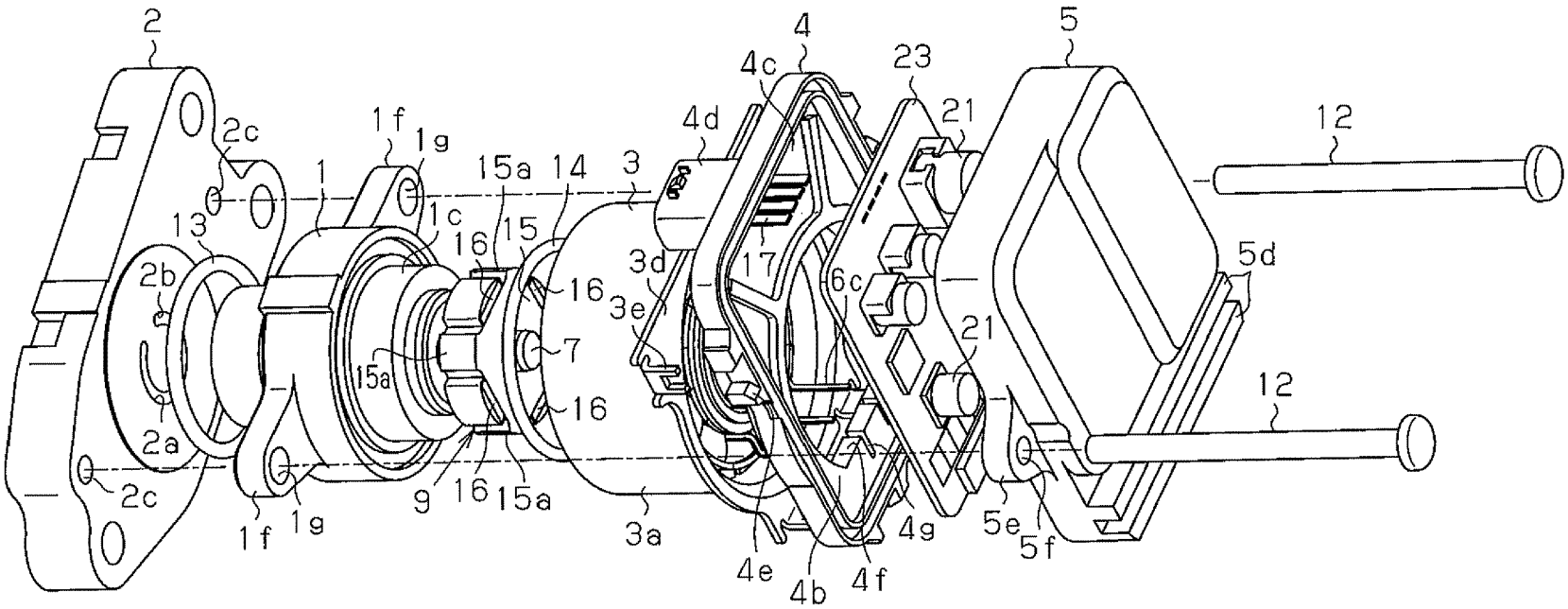
FIG. 2 is an exploded perspective view illustrating the electric pump of FIG. 1.

The pump housing 1 is formed of metal, and more specifically, is formed of an aluminum alloy, which is a nonmagnetic metal. The pump housing 1 is columnar and has a shaft support hole 1*a* at the axis for rotationally supporting the middle part of the rotary shaft 7. The rotary shaft 7 of the first embodiment is formed of stainless-steel, which is a nonmagnetic metal. Also, a pump chamber recess 1*b* is formed on the first end of the pump housing 1 (left side in FIG. 1). The pump chamber recess 1*b* is defined by a pump chamber component to define part of a pump chamber P. The pump chamber recess 1*b* is formed into a circular shape having an axis displaced from the axis of the pump housing 1 (shaft support hole 1*a*) as viewed in the axial direction. Also, a pump housing spigot cylinder 1*c* is formed on the second end of the pump housing 1 (right side in FIG. 1). The outer diameter of the pump housing spigot cylinder 1*c* is reduced and projects like a cylinder. Also, a small cylinder portion 1*d* is formed on the end of the pump housing spigot cylinder 1*c*. The outer diameter of the small cylinder portion 1*d* is further reduced and projects like a cylinder. An oil seal accommodating portion 1*e* is formed on the second end of the pump housing 1 that includes the small cylinder portion 1*d*. The diameter of the oil seal accommodating portion 1*e* is formed to be larger than the shaft support hole 1*a* so as to be able to accommodate and retain an oil seal 11. In the state in which the oil seal 11 is fitted in the oil seal accommodating portion 1*e* and also fitted on the rotary shaft 7, the oil seal 11 partitions, in a liquid-tight manner, the pump chamber P of the shaft support hole 1*a* (left side in FIG. 1) and an accommodation chamber S (right side in FIG. 1) in which the motor stator 6 is accommodated. Also, as shown in FIG. 2, a pair of fixing projections 1*f*, which projects radially outward, is formed on the outer circumferential surface of the pump housing 1. A fixing through hole 1*g*, which extends in the axial direction, is formed in each of the fixing projections 1*f*. The pump end plate 2 is fixed to the first end of the pump housing 1.

Figure 3:
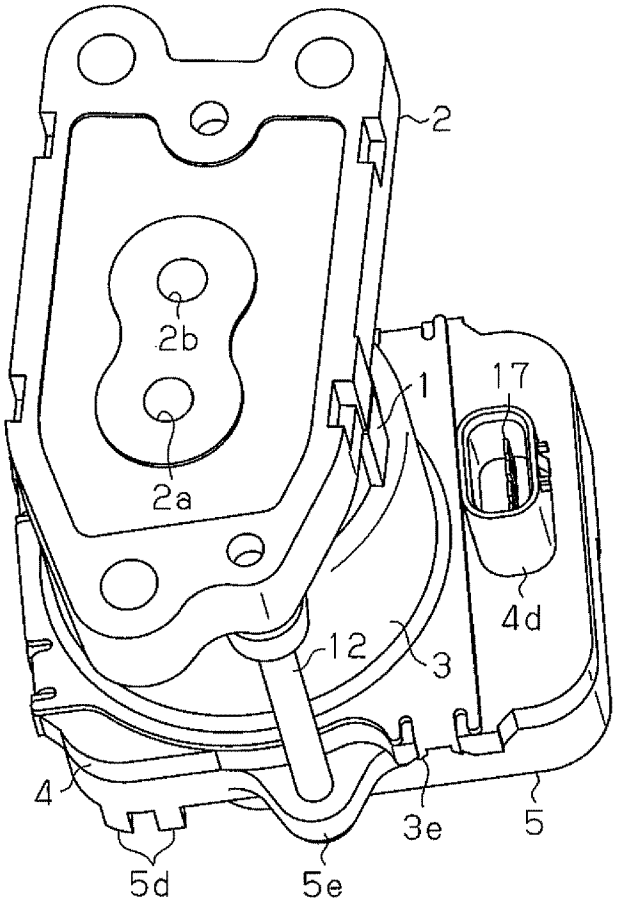
FIG. 3 is a perspective view illustrating the electric pump of FIG. 1 as viewed from the left side in FIG. 1.

The pump end plate 2 is formed of metal, and more specifically, is formed of an aluminum alloy, which is a nonmagnetic metal. The pump end plate 2 closes the pump chamber recess 1*b* as shown in FIG. 1, and forms the pump chamber P together with the pump chamber recess 1*b*. Also, the pump end plate 2 includes an inlet 2*a* and an outlet 2*b*, which connect the outside and the inside of the pump chamber P as shown in FIGS. 2 and 3. Furthermore, as shown in FIG. 2, internal threaded bores 2*c* are formed at positions on the pump end plate 2 corresponding to the fixing through holes 1*g*. The pump end plate 2 is fixed to the pump housing 1 by through bolts 12, which will be described below. At this time, a seal ring 13 is sandwiched between the pump housing 1 and the pump end plate 2 to ensure the sealing performance between the outside and the inside of the pump chamber P. The pump rotor 8 is provided on the first end of the rotary shaft 7 in the pump chamber P.

The pump rotor 8 of the first embodiment is of an internal gear type, and includes an outer rotor 8*a*, the number of teeth of which is represented by n (n is a natural number greater than or equal to 3), and an inner rotor 8*b*, the number of teeth of which is represented by n−1. The first end of the rotary shaft 7 is press-fitted in the inner rotor 8*b*.

Also, the stator case 3 is fixed to the second end of the pump housing 1.

The stator case 3 is formed of metal (for example, iron or steel), and the motor stator 6 is accommodated and fixed inside the stator case 3 as shown in FIG. 1. The motor rotor 9 provided on the second end of the rotary shaft 7 is accommodated inside the motor stator 6. More specifically, the stator case 3 is formed of a sheet metal, and includes a large cylinder portion 3*a*, a disk section 3*b*, and a stator case socket cylinder 3*c*. The motor stator 6 is fixed to the inner circumference of the stator case 3 by press-fitting. The disk section 3*b* extends radially inward from the first end of the large cylinder portion 3*a*. The stator case socket cylinder 3*c* extends from the inner edge of the disk section 3*b* toward the second end of the stator case 3 in the axial direction. The pump housing spigot cylinder 1*c* is fitted to the inner circumferential surface of the stator case socket cylinder 3*c* in a socket-and-spigot manner. The stator case 3 is preferably formed integrally by pressing. In a state in which the pump housing spigot cylinder 1*c* is fitted in the stator case socket cylinder 3*c* in a socket-and-spigot manner, the stator case 3 is fixed to the pump housing 1 by the through bolts 12, which will be discussed below. At this time, a seal ring 14 is sandwiched between the pump housing 1 and the disk section 3*b* of the stator case 3 to ensure the sealing performance between the inside and the outside.

Also, the motor stator 6 is a stator that forms an inner rotor type brushless motor together with the motor rotor 9, and is formed by winding a coil 6*b* around teeth of a stator core 6*a*. The diameter of a socket-and-spigot fitting portion of the above-described embodiment, that is, the outer diameter of the pump housing spigot cylinder 1*c* and the inner diameter of the stator case socket cylinder 3*c* are set to be larger than the inner diameter of the motor stator 6. Also, the motor rotor 9 is a consequent pole rotor as shown in FIGS. 1 and 2. That is, primary magnetic poles, which are magnets 16 in the first embodiment, are arranged on a rotor core 15 in the circumferential direction. For example, four magnets 16 are embedded in the rotor core 15 to form magnetic pole portions. Iron cores 15*a* of the rotor core 15 (see FIG. 2) each located between the magnetic pole portions are configured to function as secondary magnetic poles. The rotor core 15 of the first embodiment is a laminated core formed by laminating core sheets. Also, the motor rotor 9 of the first embodiment is a flat rotor having a diameter larger than the axial length.

Also, among the rotating bodies including the rotary shaft 7, the pump rotor 8, and the motor rotor 9, the weight moment at a section closer to the pump rotor 8 from the axial center of the shaft support hole 1*a* and the weight moment at a section closer to the motor rotor 9 from the axial center of the shaft support hole 1*a* are set to match with each other. The weight moments are values determined by the weights of the pump rotor 8 and the motor rotor 9, and the distances from the axial center of the shaft support hole 1*a* to the pump rotor 8 and the motor rotor 9.

The axial center of the motor stator 6 is slightly displaced from the axial center of the motor rotor 9 in the axial direction. The axial center of the motor stator 6 of the first embodiment is provided at a position displaced closer to the second end of the motor rotor 9 (right side in FIG. 1) than the axial center of the motor rotor 9. Thus, the motor rotor 9 and the pump rotor 8 are always urged toward the second end (right side in FIG. 1). The urging force causes the pump rotor 8 to contact the bottom surface of the pump chamber recess 1*b*, that is, the end surface of the partitioning surfaces of the pump chamber recess 1*b* that is closer to the motor stator 6 so as to slide against the end surface. In this manner, the direction in which the motor rotor 9 is urged by the motor stator 6 is opposite to the oil outlet 2*b* provided on the first end of the pump chamber P as viewed from the motor rotor 9. That is, the direction in which the motor rotor 9 is urged by the motor stator 6 is the same as the direction in which the pump rotor 8 is urged by the reaction to the oil discharged from the outlet 2*b*. Thus, the urging effect of the pump rotor 8 is enhanced in the direction toward the bottom surface of the pump chamber recess 1*b*.

Figure 4:
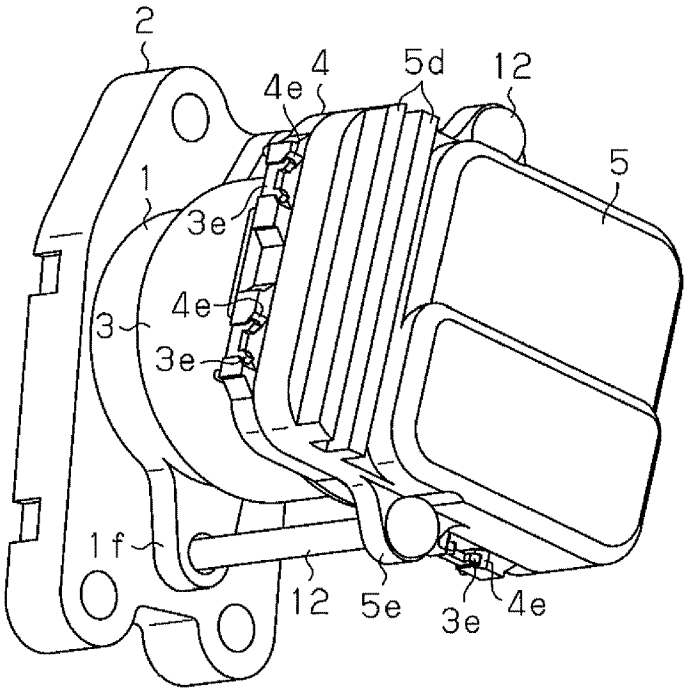
FIG. 4 is a perspective view illustrating the electric pump of FIG. 1 as viewed from the right side in FIG. 1.

As shown in FIG. 1, the circuit case member 4 is fixed to the opening of the second end of the large cylinder portion 3*a* of the stator case 3. More specifically, a flange portion 3*d*, which extends radially outward, is formed at the opening of the second end of the large cylinder portion 3*a* of the stator case 3. Clinch pieces 3*e* (only one is shown in FIG. 2), which extend in the axial direction and have a pair of arms on the distal end, are formed on the flange portion 3*d* as shown in FIG. 2. The circuit case member 4 is formed of plastic, and includes an inner fitting cylinder 4*a* and a flange abutting plate 4*b* as shown in FIG. 1. The flange abutting plate 4*b* extends radially outward, or in a direction orthogonal to the axis, from the second end (right side in FIG. 1) of the inner fitting cylinder 4*a* along the flange portion 3*d*. The inner fitting cylinder 4*a* can be fitted in the opening of the second end of the large cylinder portion 3*a* of the stator case 3. The flange abutting plate 4*b* contacts the flange portion 3*d* to cover the end surface of the flange portion 3*d*. Also, the circuit case member 4 of the first embodiment includes an extended portion 4*c*, which extends from the flange abutting plate 4*b* in a direction orthogonal to the axis (downward in FIG. 1), and a connector portion 4*d*, which extends from the extended portion 4*c* toward the first end in the axial direction (leftward in FIG. 1) and has a cylindrical shape. The first end of a connecting terminal 17 embedded in the extended portion 4*c* protrudes in the connector portion 4*d*. As shown in FIGS. 2 and 4, clinch receiving portions 4*e* are formed at positions corresponding to the clinch pieces 3*e* on the outer edge of the circuit case member 4, that is, the outer edge of the flange abutting plate 4*b*. The clinch receiving portions 4*e* are retained by the clinch pieces 3*e* by clinch the clinch pieces 3*e*, that is, by spreading the pair of arms of the clinch pieces 3*e*. In the first embodiment, the clinch pieces 3*e* and the clinch receiving portions 4*e* configure a retaining structure, which prevents the stator case 3 and the circuit case member 4 from moving relative to each other. Although the retaining structure fixes the stator case 3 and the circuit case member 4 with each other, it is a temporary retaining structure in the entire process of the fixing structure of the electric pump. The stator case 3 and the circuit case member 4 are finally tightly fixed by the later described through bolts 12.

As shown in FIGS. 1 and 2, the circuit case member 4 includes an inwardly extending portion 4*f*, which extends radially inward, or a direction orthogonal to the axis, from the second end (right side in FIG. 1) of the inner fitting cylinder 4*a*. The inwardly extending portion 4*f* includes guiding and retaining grooves 4*g*. The guiding and retaining grooves 4*g* are guiding and retaining portions for retaining coil connecting ends 6*c* of the coil 6*b* of the motor stator 6 and for guiding the coil connecting ends 6*c* toward the second end of the motor stator 6.

Also, a circuit substrate 23 is fixed to the second end (right side in FIG. 1) of the circuit case member 4. Various circuit components, which include capacitors 21 and a power transistor 22, are mounted on the circuit substrate 23. The circuit substrate 23 includes access holes through which the coil connecting ends 6*c* that are guided from the guiding and retaining grooves 4*g* can be inserted, and an access hole through which the second end of the connecting terminal 17 can be inserted. The coil connecting ends 6*c* and the connecting terminal 17 are inserted in the access holes. In a state in which the circuit case member 4 is fixed to the stator case 3 by the temporary retaining structure, the coil connecting ends 6*c* and the connecting terminal 17 are connected to the circuit substrate 23 by soldering.

As shown in FIGS. 1 and 2, the heat sink cover 5 is fixed to the circuit case member 4. The heat sink cover 5 and the stator case 3 sandwich the circuit case member 4. The heat sink cover 5 is formed of metal and includes a circuit accommodating recess 5*a* as shown in FIG. 1. The circuit accommodating recess 5*a* accommodates the circuit components such that the circuit components including the capacitors 21 and the power transistor 22 are located in the vicinity of the first end of the heat sink cover 5, that is, in the vicinity of the stator case 3. The circuit accommodating recess 5*a* of the first embodiment includes a large recess 5*b* and a small recess 5*c*. The large recess 5*b* is deep in the axial direction to be able to accommodate large circuit components such as the capacitors 21. The small recess 5*c* is shallow in the axial direction to be able to accommodate small circuit components such as the power transistor 22. The large circuit components are tall-height components, and the small circuit component is a small-height component, that is, a thin circuit component. Also, the power transistor 22 controls switching of current supplied to the coil 6*b* of the motor stator 6. The power transistor 22 is abutted against the bottom surface of the small recess 5*c* via an elastic member, which is a silicone rubber 24. The bottom surface of the small recess 5*c* is an end surface facing the first end of the heat sink cover 5, and the back surface of the small recess 5*c* is an end surface that is exposed outside and oriented toward the second end of the heat sink cover 5.

Also, dissipation fins 5*d*, which protrude in the axial direction, are formed on the back surface of the small recess 5*c* of the heat sink cover 5 as shown in FIGS. 1 and 2. The dissipation fins 5*d* of the first embodiment protrude within a range that does not protrude beyond the outer end face of the second end (right side) of the large recess 5*b* as shown in FIG. 1. Also, as shown in FIG. 2, a pair of (only one is shown in FIG. 2) fixing projections 5*e*, which project outward in a direction orthogonal to the axis, is formed at positions on the outer edge of the heat sink cover 5 corresponding to the fixing through holes 1*g* and the internal threaded bores 2*c*. The fixing projections 5*e* each include a fixing through hole 5*f*, which extends in the axial direction. The through bolts 12 extend through the fixing through holes 5*f* and the fixing through holes 1*g* and are screwed to the internal threaded bores 2*c* so that the heat sink cover 5 is fixed to the circuit case member 4 and the stator case 3. Thus, the heat sink cover 5 and the stator case 3 are fixed to sandwich the circuit case member 4.

The operation (action) of the above described embodiment will now be described.

Three-phase drive current is supplied from a non-illustrated external power source to the coil 6*b* of the motor stator 6 via the connecting terminal 17 of the connector portion 4*d* and the circuit components of the circuit substrate 23. Then, a rotating magnetic field is generated in the motor stator 6, and rotating bodies including the motor rotor 9, the rotary shaft 7, and the pump rotor 8 are integrally rotated based on the rotating magnetic field. As the pump rotor 8 is rotated, oil is drawn into the pump chamber P from the inlet 2*a*, and the oil is discharged from the outlet 2*b*.

The first embodiment has the following advantages.

(1) Heat generated in the brushless motor including the motor stator 6 and the motor rotor 9 is reliably dissipated from the stator case 3 and the pump housing 1, which are made of metal. The circuit substrate 23, which is fixed to the circuit case member 4, is separate from the stator case 3. Thus, heat of the motor stator 6 is not easily transferred from the stator case 3 directly to the circuit substrate 23. Also, since the circuit case member 4 is formed of plastic, heat of the stator case 3 is not easily transferred to the circuit substrate 23 via the circuit case member 4. Thus, the heat is not easily transferred to the circuit substrate 23 while easily dissipating heat of the motor stator 6 from the stator case 3 and the pump housing 1. As a result, the circuit components such as the capacitors 21 and the power transistor 22 are prevented from being damaged by heat.

(2) The plastic circuit case member 4 is provided between the stator case 3 and the heat sink cover 5. Thus, heat generated in the motor stator 6 is not easily transferred to the heat sink cover 5, which is made of metal, and the circuit accommodating recess 5*a*. Thus, heat generated in the brushless motor is not easily transferred to the circuit components accommodated in the circuit accommodating recess 5*a* of the heat sink cover 5. Since heat generated in the circuit components is reliably dissipated from the heat sink cover 5, the circuit components are prevented from being damaged by heat.

(3) The circuit accommodating recess 5*a* includes the large recess 5*b*, which is deep in the axial direction to be able to accommodate the large circuit components such as the capacitors 21, and the small recess 5*c*, which is shallow in the axial direction to be able to accommodate a small and thin circuit component such as the power transistor 22. The dissipation fins 5*d*, which project in the axial direction, are formed on the back surface of the small recess 5*c* of the heat sink cover 5. Thus, the dissipation fins 5*d* are prevented from increasing the entire axial length of the electric pump, and the dissipation fins 5*d* improve the dissipation performance.

(4) The power transistor 22 for controlling the motor stator 6 is accommodated in the small recess 5*c*. Thus, heat from the power transistor 22, which easily generates heat, is efficiently dissipated from the dissipation fins 5*d*, which are formed on the back surface of the small recess 5*c*.

(5) The power transistor 22 is mounted on the circuit substrate 23 fixed to the circuit case member 4. Furthermore, the power transistor 22 is abutted against the bottom surface of the small recess 5*c* via the silicone rubber 24. Thus, heat from the power transistor 22 is more efficiently dissipated from the dissipation fins 5*d*, which are formed on the back surface of the small recess 5*c*, via the silicone rubber 24 without requiring high dimensional accuracy.

(6) The circuit case member 4 has the guiding and retaining grooves 4*g*, which retain the coil connecting ends 6*c*. The guiding and retaining grooves 4*g* guide the coil connecting ends 6*c* toward the circuit accommodating recess 5*a*. The stator case 3 and the circuit case member 4 have the clinch pieces 3*e* and the clinch receiving portions 4*e*, which serve as the retaining structure that prevents the stator case 3 and the circuit case member 4 from moving relative to each other. Thus, the coil connecting ends 6*c* are arranged in a stable manner facing toward the circuit accommodating recess 5*a*. If the structure does not include the guiding and retaining grooves 4*g* nor the retaining structure, which includes the clinch pieces 3*e* and the clinch receiving portion 4*e*, the coil connecting ends 6*c* may move freely and undesirably deform. Thus, for example, it might be difficult to improve the reliability of the connection between the coil connecting ends 6*c* and the circuit substrate 23, which is fixed to the circuit case member 4. However, the first embodiment improves the connection reliability of the coil connecting ends 6*c*.

(7) The rotor core 15 is a laminated core formed by laminating core sheets. Thus, eddy current that tends to occur by employing the consequent pole rotor is reduced. Thus, the brushless motor becomes highly efficient, and generation of heat in the rotor core 15 is reduced. Thus, the circuit components are further prevented from being damaged by heat.

(8) The circuit case member 4 is formed of a flexible plastic material. Since the circuit case member 4 absorbs vibration of the stator case 3, the vibration is prevented from being transmitted from the motor stator 6 to the circuit substrate 23 via the circuit case member 4.

The above described embodiment may be modified as follows.

In the above described embodiment, the stator case 3 includes the large cylinder portion 3*a*, the disk section 3*b*, and the stator case socket cylinder 3*c*. The pump housing spigot cylinder is fit in the stator case socket cylinder 3*c* in an axially long range in the socket-and-spigot manner. However, the shape and the configuration of parts may be modified as long as the stator case is fit to the pump housing in the socket-and-spigot manner.

Figure 5:
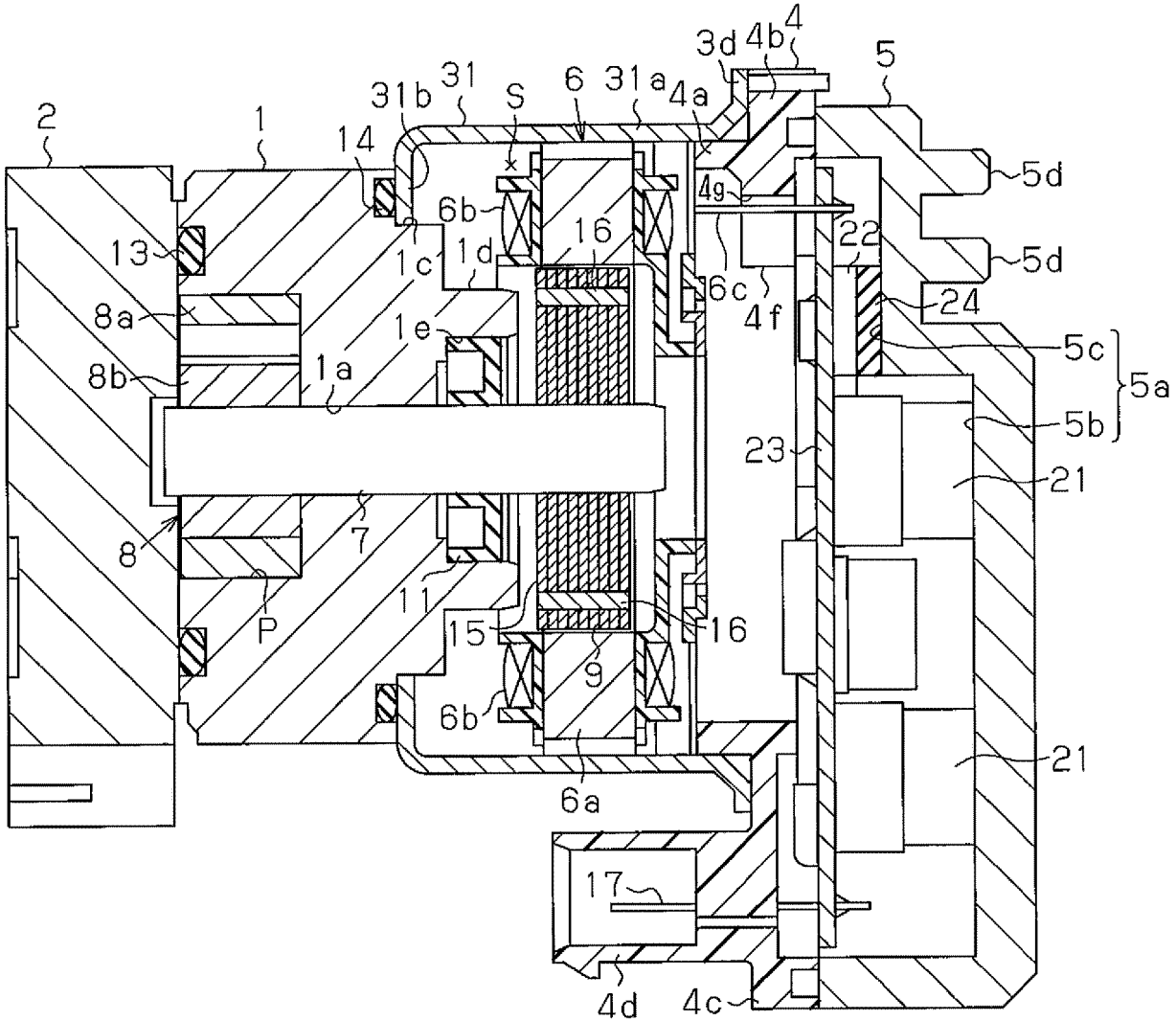
FIG. 5 is a cross-sectional view illustrating an electric pump according to a modification.

For example, the present invention may be modified as shown in FIG. 5. A stator case 31 is formed of a sheet metal, and includes a large cylinder portion 31*a* and a stator case socket disk 31*b*, which extends radially inward from the first end of the large cylinder portion 31*a*. The motor stator 6 is fixed on the inner circumference of the large cylinder portion 31*a*. The pump housing spigot cylinder 1*c* is fitted to the inner circumferential surface of the stator case socket disk 31*b* in the socket-and-spigot manner. Thus, since the stator case 31 is formed of a sheet metal, the stator case 31 can be manufactured at a low cost while having high rigidity as compared to a stator case formed of plastic as a comparative example. Also, the stator case 31 has a simple shape, and is manufactured at lower costs as compared to the above-described embodiment including the stator case socket cylinder 3*c*.

According to the above-described embodiment, the axial lengths, that is, the thicknesses of the radially inward part and the radially outward part of the rotor core 15 are constant. However, the axial length of the rotor core at the radially inward part, in which the rotary shaft 7 is press-fitted, may be shorter than the axial length of the radially outward part.

Figure 6A:
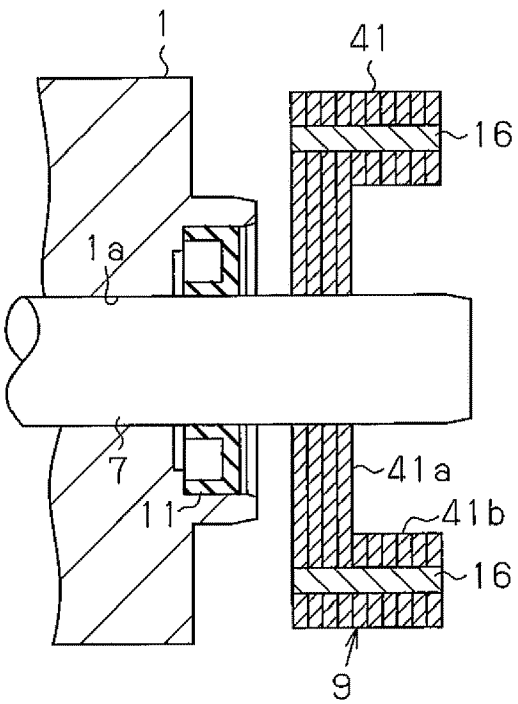
FIGS. 6(*a*) to 6(*c*) are partial cross-sectional views illustrating electric pumps of modifications each including a different rotor core.
Figure 6B:
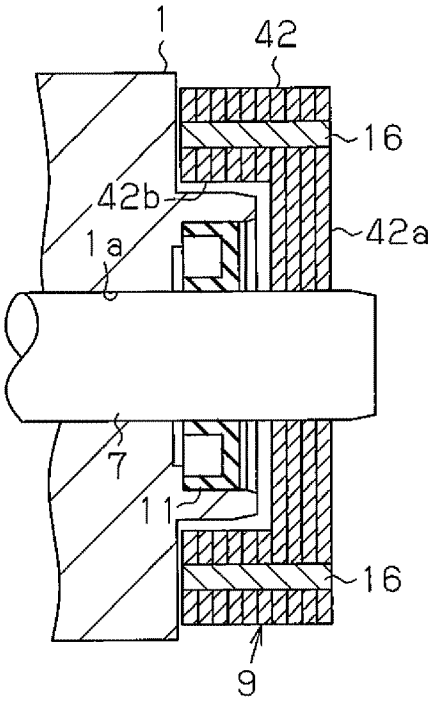
Figure 6C:
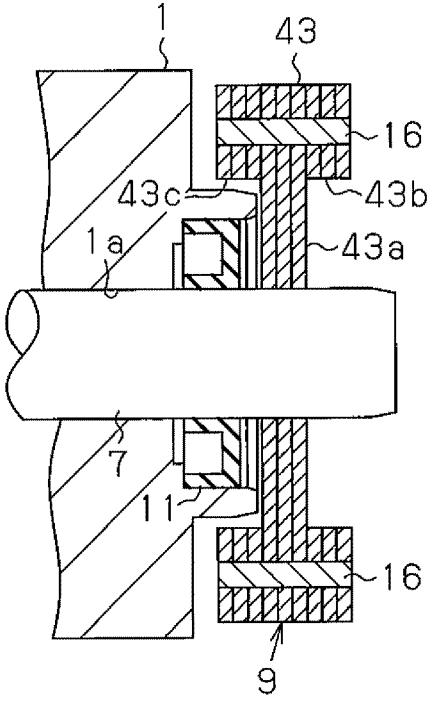

For example, the invention may be modified as shown in FIG. 6(*a*). A far-side annular recess 41*b*, which is far from the pump housing 1, is formed in a rotor core 41 of this example by reducing the axial length of a radially inward part 41*a*. The far-side annular recess 41*b* is located on the opposite side (right side in the drawing) of the rotor core 41 from the pump housing 1.

In this case, the weight of the rotor core 41 is reduced. Thus, for example, the weight moment of part of the rotating body close to the motor rotor 9 is reduced, and is easily set to match with the weight moment of the part of the rotating body close to the pump rotor 8. Also, the far-side annular recess 41*b* is formed in part of the rotor core 41 on the opposite side from the pump housing 1, that is, the right side in the drawing, and at a position far from the shaft support hole 1*a*. Thus, as compared to a case in which a near-side annular recess is formed in the vicinity of only the pump housing 1 as a comparative example, the weight moment of part of the rotating body close to the motor rotor 9 is further reduced. Thus, for example, it is possible to set the weight moment of part of the rotating body close to the motor rotor 9 and the weight moment of part of the rotating body close to the pump rotor 8 to easily match with each other.

The invention may be modified as shown in FIG. 6(*b*). In a rotor core 42 of this example, a near-side annular recess 42*b* is formed at a part of the rotor core 42 close to the pump housing 1. The near-side annular recess 42*b* is formed by reducing the axial length of the radially inward part 42*a* of the rotor core 42. At least part of the oil seal 11, in this example, the entire oil seal 11 is arranged in the near-side annular recess 42*b*.

In this case, the weight of the rotor core 42 is reduced. Thus, for example, the weight moment of part of the rotating body close to the motor rotor 9 is reduced, and is easily set to match with the weight moment of part of the rotating body close to the pump rotor 8. Also, at least part of the oil seal 11, in this example, the entire oil seal 11 is arranged in the near-side annular recess 42*b*. Thus, the entire axial length of the electric pump is reduced as compared to a case in which the oil seal 11 is not arranged in the near-side annular recess 42*b* as a comparative example such as the manner in FIG. 1 and the manner in FIG. 6(*a*).

The invention may be modified as shown in FIG. 6(*c*). In a rotor core 43 of this example, a far-side annular recess 43*b*, which is far from the pump housing 1, and a near-side annular recess 43*c*, which is close to the pump housing 1, are both formed. That is, the axial length of a radially inward part 43*a* of the rotor core 43 is reduced to form the far-side annular recess 43*b* at a position of the rotor core 43 opposite from the pump housing 1, and the near-side annular recess 43*c* at a position of the rotor core 43 near the pump housing 1. At least part of the oil seal 11, in this example, half the oil seal 11 is arranged in the near-side annular recess 43*c* that is near the pump housing 1. In this case also, the advantages of the above modified embodiments are obtained.

In the above-described embodiment, the diameter of a socket-and-spigot fitting portion of the pump housing 1 and the stator case 3, that is, the outer diameter of the pump housing spigot cylinder is and the inner diameter of the stator case socket cylinder 3*c* are set to be larger than the inner diameter of the motor stator 6. However, the diameter of a socket-and-spigot fitting portion may be set equal to the inner diameter of the motor stator 6.

In the above-described embodiment, the pump housing 1 and the stator case 3 are fastened by the through bolts 12. The through bolts 12 extend from the first end of the pump housing 1 to the second end of the stator case 3, which are the axial ends located far from each other. Furthermore, the through bolts 12 extend from the pump end plate 2 to the heat sink cover 5, which are members on both sides of the electric pump. However, the pump housing 1 may be fixed to the stator case 3 by other structure.

In the above-described embodiment, the circuit accommodating recess 5*a* includes the large recess 5*b* and the small recess 5*c*. However, for example, the circuit accommodating recess may have a constant depth.

In the above-described embodiment, the dissipation fins 5*d*, which project in the axial direction, are formed on the back surface of the small recess 5*c* of the heat sink cover 5. However, for example, the heat sink cover does not necessarily have to include the dissipation fins 5*d*, or the dissipation fins may be formed on the back surface of the large recess 5*b*.

In the above-described embodiment, the power transistor 22 is accommodated in the small recess 5*c*. However, the structure does not need to accommodate the power transistor 22. Also, in the above-described embodiment, the power transistor 22 contacts the bottom surface of the small recess 5*c* via the silicone rubber 24. However, for example, the structure does not necessarily have to include the silicone rubber 24. In this case, the power transistor 22 does not contact the bottom surface of the small recess 5*c*.

In the above described embodiment, the circuit case member 4 includes the guiding and retaining grooves 4*g*. The stator case 3 and the circuit case member 4 include the clinch pieces 3*e* and the clinch receiving portions 4*e*, which serve as the retaining structure that prevents movement relative to each other. However, the structure does not necessarily have to include the guiding and retaining grooves 4*g* and the retaining structure, which includes the clinch pieces 3*e* and the clinch receiving portions 4*e*. Also, the guiding and retaining portions of the above described embodiment are not limited to the guiding and retaining grooves 4*g* as long as the guiding and retaining portions retain the coil connecting ends 6*c* and guide the coil connecting ends 6*c* toward the circuit accommodating recess 5*a*. For example, the guiding and retaining portion may be changed to a guiding and retaining hole that extends through the inwardly extending portion 4*f* in the axial direction.

In the above described embodiment, the rotor core 15 is a laminated core formed by laminating core sheets. However, for example, the rotor core 15 may be changed to a rotor core formed of a sintered metal.

In the above described embodiment, the motor rotor 9 is a consequent pole rotor. However, the motor rotor 9 may be changed to other types of rotors.

In the above described embodiment, the rotating body including the rotary shaft 7, the pump rotor 8, and the motor rotor 9 is set such that the weight moment of a part close to the pump rotor 8 from the axial center of the shaft support hole 1*a* matches with the weight moment of a part close to the motor rotor 9 from the axial center of the shaft support hole 1*a*. However, it is not necessary to set as described above.

In the above described embodiment, the axial center of the motor stator 6 is provided to be located closer to the second end of the motor rotor 9 than the axial center of the motor rotor 9. That is, the axial center of the motor stator 6 is located at a position displaced in a direction to separate from the pump chamber P. However, the axial center of the motor stator 6 may be located near the first end, that is, at a position displaced toward the pump chamber P.

In the above described embodiment, the axial center of the motor stator 6 is located at a position displaced in the axial direction from the axial center of the motor rotor 9. However, the motor stator 6 and the motor rotor 9 may be provided such that the axial centers of the motor stator 6 and the motor rotor 9 match with each other.

In the above described embodiment, the motor rotor 9 is a flat rotor that has a diameter larger than the axial length. However, the motor rotor 9 may be changed to a rotor that has an axial length greater than the diameter.

In the above described embodiment, the pump operating portion, which is the pump rotor 8, is of an internal gear type. However, the pump operating portion may be changed to other pump rotor as long as it draws in and discharges fluid.

In the above described embodiment, the circuit substrate 23 may be fixed to the circuit case member 4 by thermal staking. With this structure, the circuit case member 4 and the circuit substrate 23 are fixed to each other without using a fixing member such as bolts. As a result, the structure is simplified.

A second embodiment of the present invention will now be described with reference to FIGS. 7 to 11.

In an electric pump according to the second embodiment, mainly the circuit case member differs from the first embodiment, and the fixing configuration of the circuit substrate is also different. Thus, hereinafter, like or the same reference numerals are given to those components that are like or the same as the corresponding components of the first embodiment and detailed explanations are omitted.

Figure 7:
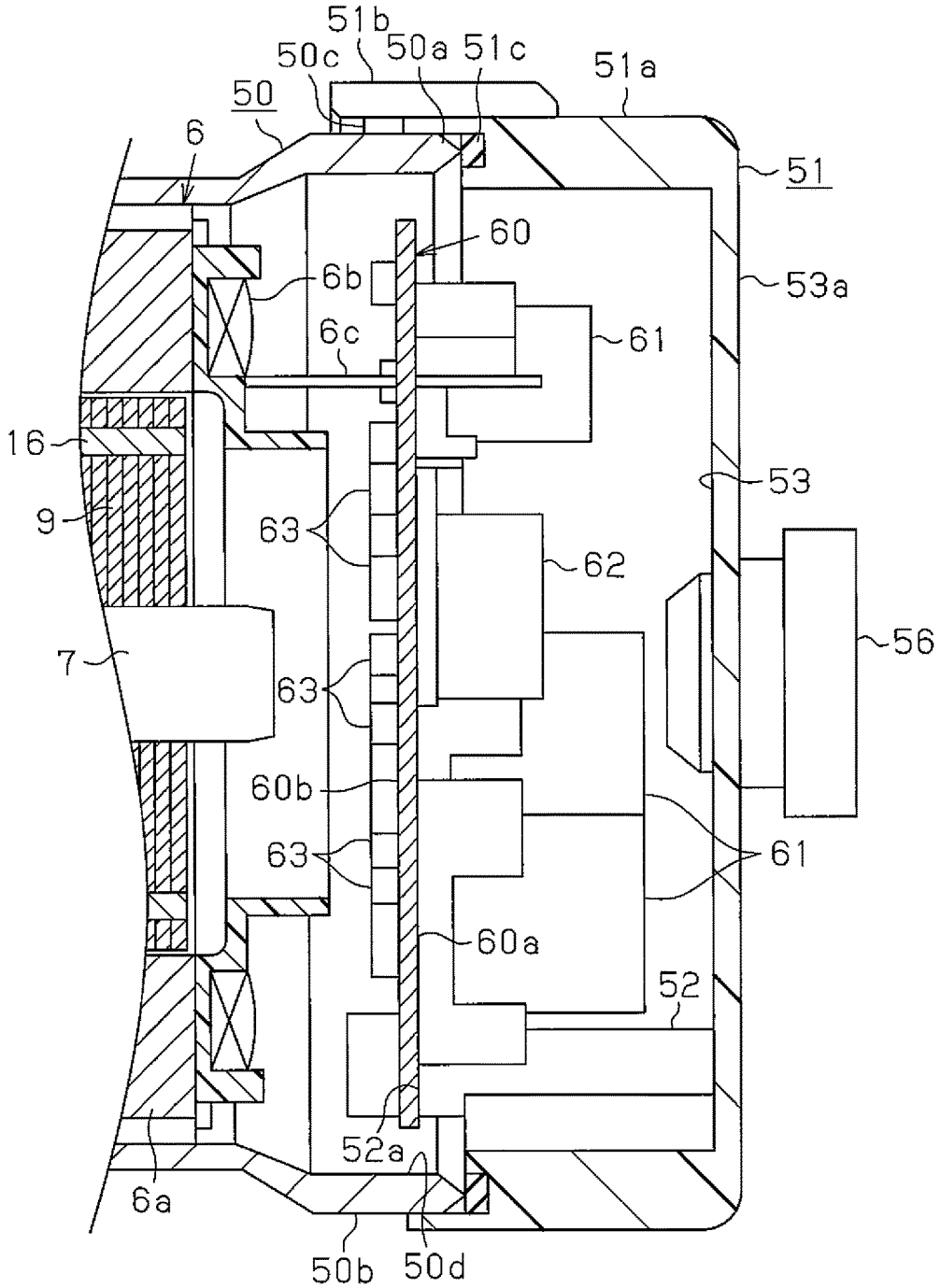
FIG. 7 is an enlarged cross-sectional view illustrating a circuit case member of an electric pump according to a second embodiment.

As shown in FIG. 7, a motor case of the electric pump according to the second embodiment, which is a stator case 50, is formed of, for example, an iron or steel cylindrical member. The stator case 50 accommodates a motor section (the motor stator 6 and the motor rotor 9). The pump housing 1, which is identical to that of the first embodiment, is fixed to the first end of the stator case 50 in the axial direction. An open end 50*a* is located at the second end of the stator case 50 on the opposite side from the pump housing 1, and a circuit case member 51, which closes the open end 50*a*, is mounted on the open end 50*a*. The stator case 50 has a large diameter portion 50*b*, which has a diameter larger than the axially middle part of the stator case 50. The large diameter portion 50*b* extends from the open end 50*a* toward the first end of the stator case 50 along a predetermined length in the axial direction.

Figure 8:
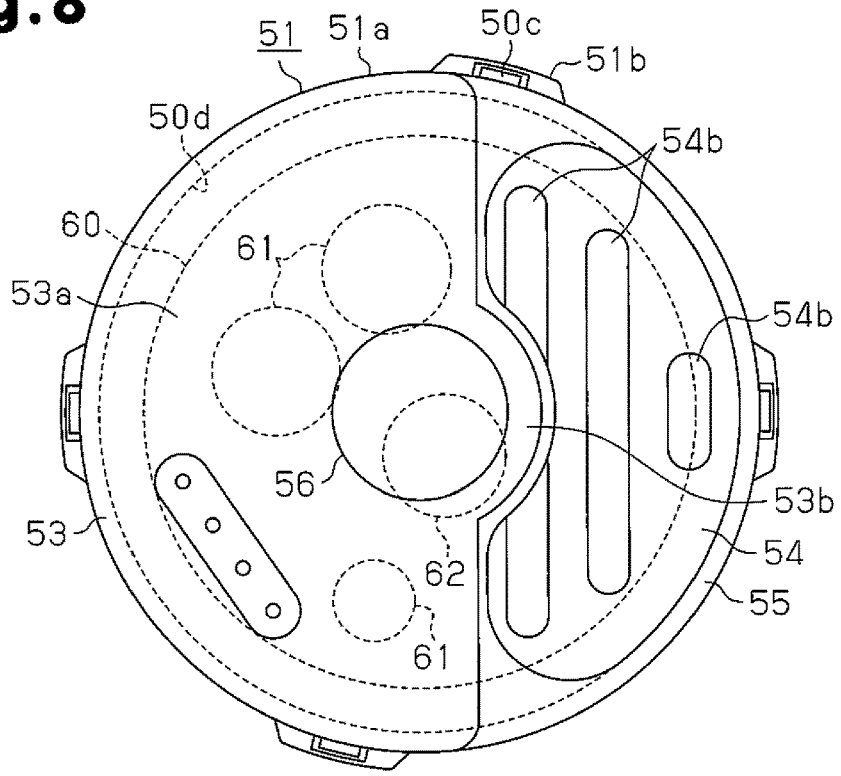
FIG. 8 is a side view illustrating the electric pump of FIG. 7 as viewed from the right side in FIG. 7.

The circuit case member 51 is formed of a flexible plastic material, and has a circular shape that is coaxial with the stator case 50 as viewed in the axial direction as shown in FIG. 8. Engaging pieces 51*b*, which project radially outward, are provided on an outer circumferential wall 51*a* of the circuit case member 51 in the circumferential direction (four in the second embodiment). Each of the engaging pieces 51*b* are engaged with corresponding one of engaging projections 50*c* provided on the outer circumferential surface of the large diameter portion 50*b* so that the circuit case member 51 is fixed to the large diameter portion 50*b*. A seal ring 51*c* (see FIG. 7) is arranged between the open end 50*a* of the stator case 50 and the circuit case member 51 to ensure the sealing performance between the open end 50*a* of the stator case 50 and the circuit case member 51.

A circuit substrate 60 is fixed to the circuit case member 51 to be located at part of the circuit case member 51 close to the stator case 50. Various circuit components such as capacitors 61, a noise eliminating element, which is a coil 62, power transistors 63, and a control IC 64 are mounted on the circuit substrate 60.

Figure 9:
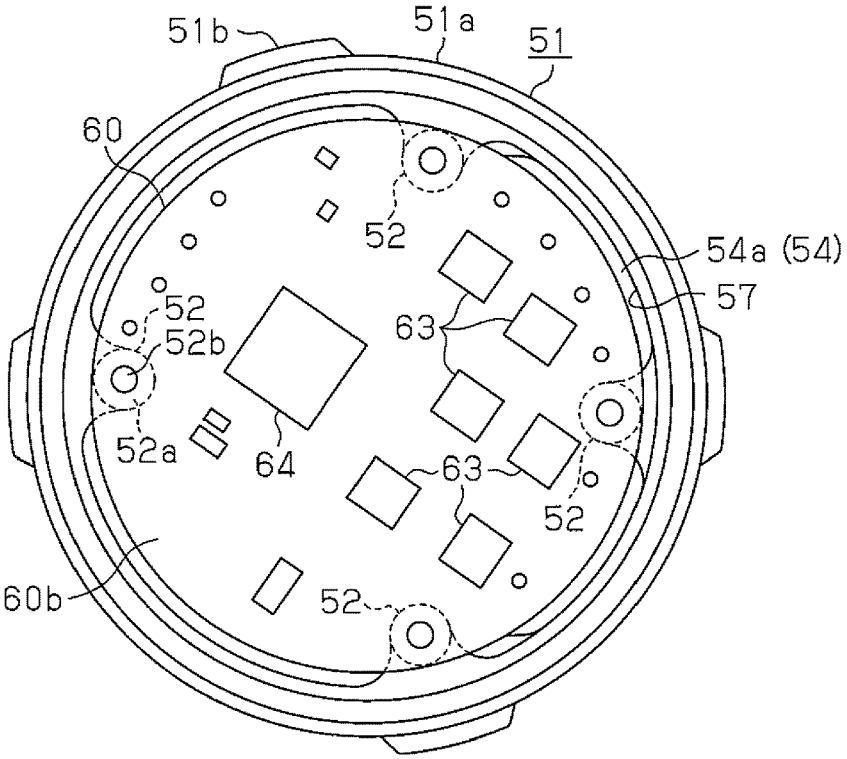
FIG. 9 is a side view illustrating the circuit case member of FIG. 7 to which the circuit substrate is fixed as viewed from the left side in FIG. 7, that is, from the stator case.

More specifically, substrate fixing portions 52 (four in the second embodiment), which bulge radially inward from the outer circumferential wall 51*a* and extend in the axial direction, are formed on the circuit case member 51 as shown in FIG. 9. Each substrate fixing portion 52 has a contact surface 52*a*, which contacts the circuit substrate 60, and the contact surfaces 52*a* are formed to be located on the same plane orthogonal to the axis of the rotary shaft 7.

A projection 52*b*, which projects in the axial direction, is formed on each contact surface 52*a*. In a state in which the projections 52*b* are inserted in the circuit substrate 60 and the contact surfaces 52*a* contact the circuit substrate 60, the projections 52*b* are melted by heat so that the circuit substrate 60 is thermally crimped to the contact surfaces 52*a*.

The circuit substrate 60 is fixed to be orthogonal to the axis of the rotary shaft 7 by contacting the contact surfaces 52*a* (see FIG. 7). Also, the circuit substrate 60 has a circular shape as viewed in the axial direction, and is fixed such that the center of the circuit substrate 60 matches with the center of the circuit case member 51, that is, the axis of the stator case 50. As shown in FIG. 8, the circuit substrate 60 has a smaller diameter than an inner circumferential surface 50*d* of the large diameter portion 50*b* of the stator case 50. The circuit substrate 60 is fixed to the substrate fixing portions 52 at a position axially inward than the open end 50*a* of the stator case 50. That is, the circuit substrate 60 is located inside the large diameter portion 50*b* of the stator case 50.

Figure 10:
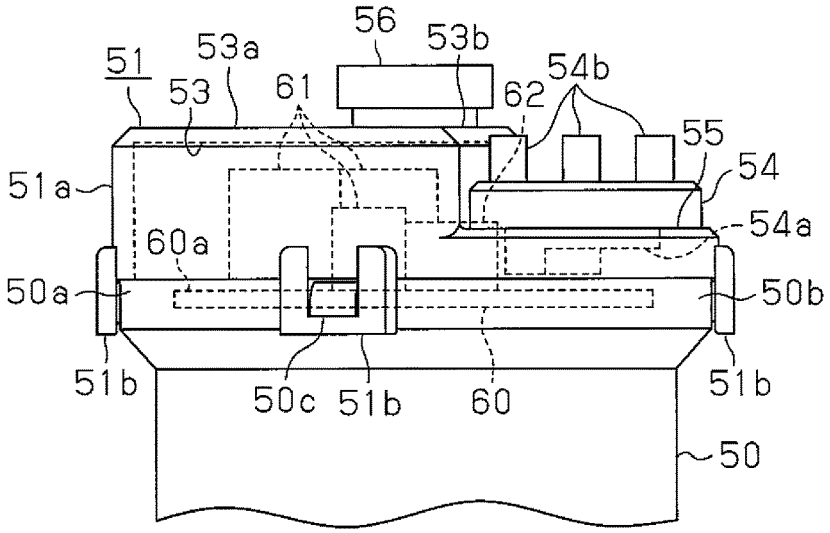
FIG. 10 is a side view illustrating the external appearance of the circuit case member of FIG. 7.

As shown in FIGS. 7 and 10, an accommodating recess 53 is formed in the circuit case member 51, and the accommodating recess 53 accommodates the capacitors 61 and the coil 62, which are mounted on a second substrate surface 60*a* of the circuit substrate 60. The second substrate surface 60*a* is a plate surface of the circuit substrate 60 on the opposite side from the motor section. A first substrate surface 60*b* is a plate surface of the circuit substrate 60 facing the motor section.

As shown in FIG. 8, the accommodating recess 53 is formed in a range slightly larger than the semicircle that is half the outer shape of the circuit case member 51, which has a circular shape as viewed in the axial direction. A heat sink mounting portion 55 is formed at part of the circuit case member 51 other than the accommodating recess 53. A heat sink 54 made of metal (for example, aluminum) is mounted on the heat sink mounting portion 55. As shown in FIG. 10, a bottom wall 53*a* (ceiling in FIG. 10) of the accommodating recess 53 and the heat sink mounting portion 55 has different axial height. The accommodating recess 53 is more deeply recessed in a direction away from the circuit substrate 60 as compared to the heat sink mounting portion 55. That is, the circuit case member 51 has a step formed by the accommodating recess 53 and the heat sink mounting portion 55.

As shown in FIG. 8, a vent 56 for adjusting the pressure in the electric pump is provided on the bottom wall 53*a* (axial end surface) of the accommodating recess 53. The vent 56 is provided corresponding to the axial center (radial center) of the circuit case member 51, and a projection 53*b*, which projects toward the heat sink mounting portion 55 as to bulge in the radial direction, is formed at part of the accommodating recess 53 corresponding to the vent 56. The heat sink 54 is a recess formed along the projection 53*b* as viewed in the axial direction.

As shown in FIGS. 8 and 10, the accommodating recess 53 is a section that accommodates components that are relatively tall (tall-height components) among the circuit components mounted on the second substrate surface 60*a* of the circuit substrate 60. In the second embodiment, the three capacitors 61 and the coil 62 are tall-height components, and are arranged on a region of the second substrate surface 60*a* of the circuit substrate 60 corresponding to the accommodating recess 53.

Figure 11:
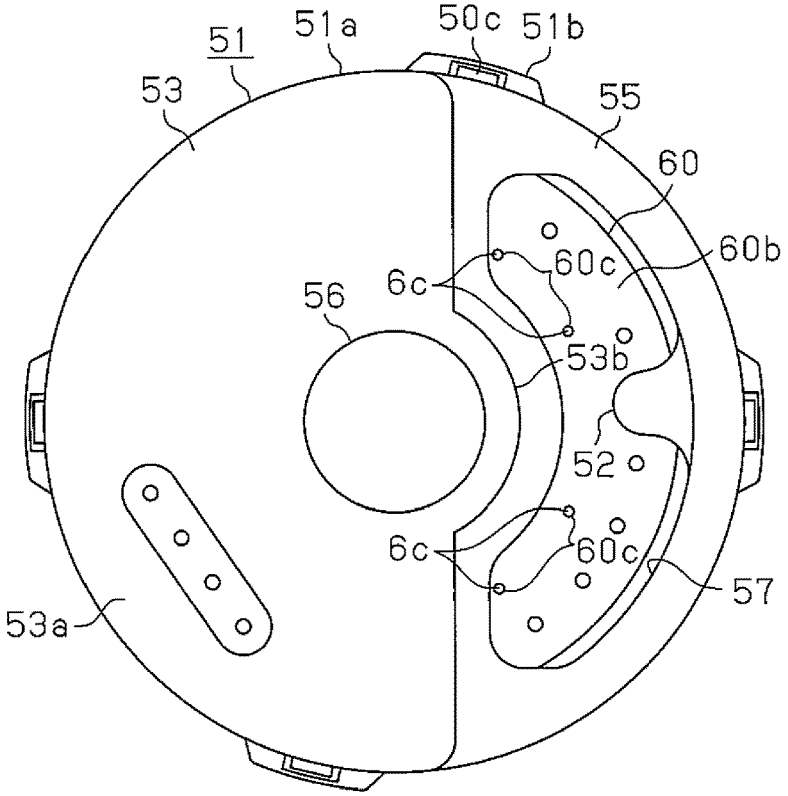
FIG. 11 is a side view illustrating a state in which the circuit case member is partially exposed by removing the heat sink from the electric pump of FIG. 8.

As shown in FIG. 11, a semi-arcuate through hole 57, which extends in the axial direction of the rotary shaft 7, is formed in the heat sink mounting portion 55. The heat sink 54 is fixed to the heat sink mounting portion 55 to close the through hole 57. More specifically, the heat sink 54 has a fitting portion 54*a* (see FIG. 10), which is fitted in the through hole 57. The fitting portion 54*a* closes the through hole 57. Also, the fitting portion 54*a* extends inside the heat sink mounting portion 55 and is exposed toward the stator case 50 by being fitted in the through hole 57. That is, the fitting portion 54*a* of the heat sink 54 is in the vicinity of the second substrate surface 60*a* of the circuit substrate 60.

In this manner, the circuit case member 51 of the second embodiment covers the open end 50*a* of the stator case 50 with the accommodating recess 53 and the heat sink mounting portion 55. Since the through hole 57 formed in the heat sink mounting portion 55 is closed by the heat sink 54, the open end 50*a* of the stator case 50 is sealed.

As shown in FIG. 10, the heat sink 54 mounted on the heat sink mounting portion 55 is arranged side-by-side with the accommodating recess 53 in a direction orthogonal to the rotary shaft 7. Dissipation fins 54*b*, which project axially outward (opposite to a fitting portion), are formed on the heat sink 54. The dissipation fins 54*b* project in a range that the dissipation fins 54*b* do not project more than the bottom wall 53*a* of the accommodating recess 53 in the axial direction. Thus, while preventing the entire axial length of the electric pump from being increased by the dissipation fins 54*b*, the dissipation fins 54*b* improve the dissipation performance of the heat sink 54.

Also, as shown in FIG. 8, the heat sink 54 is provided inward than the outer shape of the circuit case member 51, or the outer circumferential surface as viewed in the axial direction. That is, the heat sink 54 is smaller as compared to the circuit case member 51, and forms a part of the circuit case member 51. The area of the heat sink 54 as viewed in the axial direction is smaller than the circuit substrate 60.

As shown in FIG. 11, introduction bores 60*c* are formed through the circuit substrate 60 in the axial direction of the rotary shaft 7. The axes of the introduction bores 60*c* (lines along the extending direction) are parallel to the axis of the rotary shaft 7, and the axes of the introduction bores 60*c* pass through the through hole 57 of the circuit case member 51. That is, the introduction bores 60*c* are formed within a projected range of the through hole 57 in the axial direction. The coil connecting ends 6*c* drawn out from the coil 6*b* of the motor stator 6 are inserted in the introduction bores 60*c*, and the coil connecting ends 6*c* are electrically connected to the circuit substrate 60 by soldering. While connecting the coil connecting ends 6*c*, the through hole 57 serves as an operation window in a state in which the heat sink 54 is not mounted. Thus, the connection between the introduction bores 60*c* and the coil connecting ends 6*c* can be visually checked via the through hole 57.

As shown in FIG. 9, the power transistors 63 (six in this embodiment) and the control IC 64 are mounted on the first substrate surface 60*b* of the circuit substrate 60 (the back of the second substrate surface 60*a*). The power transistors 63 and the control IC 64 are small-height circuit components as compared to the capacitors 61 and the coil 62 accommodated in the accommodating recess 53. The small-height circuit components are concentrated on the first substrate surface 60*b*.

The power transistors 63 perform switching control of current supplied to the coil 6*b* of the motor stator 6, and are circuit components that tend to generate heat. In the second embodiment, at least some of the power transistors 63 are arranged within the projected range of the heat sink 54 in the axial direction. Thus, the power transistors 63 are arranged in the vicinity of the heat sink 54, and heat generated in the power transistors 63 are efficiently dissipated.

The operation of the second embodiment will now be described.

The stator case 50 is formed of metal, and the plastic circuit case member 51 is fixed to the open end 50*a* of the stator case 50 on the opposite side from the metal pump housing 1. Thus, heat generated at the motor section (the motor rotor 9 and the motor stator 6) is reliably dissipated from the stator case 50 and the pump housing 1. The circuit substrate 60 is fixed to the circuit case member 51, and is separated from the stator case 50. Thus, heat of the motor section is not easily transferred directly from the stator case 50 to the circuit substrate 60. Also, since the circuit case member 51 is formed of plastic, heat of the stator case 50 is not easily transferred to the circuit substrate 60 via the circuit case member 51. Thus, while facilitating dissipation of heat of the motor section from the stator case 50 and the pump housing 1, heat is prevented from being transferred to the circuit substrate 60. As a result, the circuit components are prevented from being damaged by heat. Also, vibration generated at the pump rotor 8 and the motor section is prevented from being directly transmitted from the stator case 50 to the circuit substrate 60. As a result, the circuit substrate 60 and the circuit components are prevented from being damaged by vibration.

Also, the circuit case member 51 is fixed to the open end 50*a* of the stator case 50, and the heat sink 54 is provided to form a part of the circuit case member 51. That is, since the plastic circuit case member 51 is arranged between the stator case 50 and the heat sink 54, heat generated at the motor section is easily transferred to the metal pump housing 1 and is hindered from being transferred to the heat sink 54.

Also, the circuit substrate 60 fixed to the circuit case member 51 is configured to be located inside the large diameter portion 50*b* of the stator case 50. If a structure in which the circuit substrate 60 is arranged in the circuit case member 51 unlike the second embodiment is considered as a comparative example, the size of the circuit case member 51 is increased in the axial direction. Furthermore, in the structure in which the circuit substrate 60 is arranged in the circuit case member 51, the axial length of the stator case 3 may be reduced to prevent the entire length or the axial length of the electric pump from being changed, that is, to prevent the entire length of the electric pump from being increased. That is, the ratio of the stator case 3 with respect to the entire length of the electric pump may be reduced. However, if the axial length of the stator case 3 is reduced, dissipating performance of the stator case 3 that dissipates heat of the motor section is reduced. In this respect, the second embodiment prevents the entire length of the electric pump from being increased since the circuit substrate 60 is arranged inside the stator case 50, without reducing the axial length of the stator case 3, that is, without reducing the ratio of the stator case 3 with respect to the entire length of the electric pump. That is, the second embodiment prevents the entire length of the electric pump from being increased while ensuring the axial length of the stator case 50 required to reliably dissipate the heat.

The second embodiment has the following advantages.

(9) The plastic circuit case member 51 is fixed to the open end 50*a* of the stator case 50. The circuit components for controlling activation of the motor section (the motor rotor 9 and the motor stator 6) are mounted on the circuit substrate 60. The circuit substrate 60 is fixed to the circuit case member 51 and is separate from the stator case 50. With this structure, heat generated at the motor section is reliably dissipated from the metal stator case 50 and the pump housing 1 located on the opposite side from the circuit case member 51. Also, since the circuit substrate 60 fixed to the circuit case member 51 is separate from the stator case 50, heat of the motor section is not easily transferred from the stator case 50 directly to the circuit substrate 60. Also, since the circuit case member 51 is formed of plastic, heat of the stator case 50 is not easily transferred to the circuit substrate 60 via the circuit case member 51. Thus, heat is prevented from being transferred to the circuit substrate 60 while facilitating dissipation of heat of the motor section from the stator case 50 and the pump housing 1. As a result, the circuit components are prevented from being damaged by heat. Also, vibration generated at the pump rotor 8 and the motor section is prevented from being directly transmitted from the stator case 50 to the circuit substrate 60. As a result, the circuit substrate 60 and the circuit components are prevented from being damaged by vibration.

(10) The electric pump includes the metal heat sink 54 for dissipating heat of the circuit components. The circuit case member 51 is located between the heat sink 54 and the stator case 50. With this structure, since the plastic circuit case member 51 is located between the stator case 50 and the heat sink 54, heat generated at the motor section is easily transferred to the metal pump housing 1 and is prevented from being transmitted to the heat sink 54. Thus, the heat sink 54 is allowed to dedicate to dissipating heat generated at the circuit components. Thus, heat of the circuit components is reliably dissipated from the heat sink 54. As a result, the circuit components are prevented from being damaged by heat.

(11) The circuit substrate 60 is configured to be located inside the large diameter portion 50*b* of the stator case 50. Thus, the entire length of the electric pump is prevented from being increased, and the size of the electric pump in the axial direction is prevented from being increased while ensuring the axial length of the stator case 50 required for reliably dissipating the heat.

(12) The circuit case member 51 retains the circuit substrate 60 such that the circuit substrate 60 is located in the vicinity of the stator case 50. Furthermore, the circuit case member 51 includes the through hole 57, which extends in the axial direction of the rotary shaft 7. The heat sink 54 is provided to close the through hole 57. With this configuration, the heat sink 54, which closes the through hole 57 of the circuit case member 51, is exposed in the vicinity of the stator case 50, near which the circuit substrate 60 is retained. Thus, heat generated at the circuit components is efficiently transferred to the heat sink 54. As a result, heat of the circuit components is efficiently dissipated.

(13) The heat sink 54 is located inward than the outer shape of the circuit case member 51 as viewed in the axial direction of the rotary shaft 7. Thus, the size of the heat sink 54, which is made of metal that has a higher specific gravity as compared to plastic, is reduced. Therefore, load such as imposed load that the heat sink 54 applies to the plastic circuit case member 51 is efficiently reduced. Also, since the circuit case member 51 is formed of plastic, deterioration by heat from the motor case is concerned. Thus, reducing the imposed load of the heat sink 54 on the circuit case member 51 is effective in terms of reducing deterioration of the circuit case member 51.

(14) The introduction bores 60*c* are formed in the circuit substrate 60, and are connected to the connecting portions drawn out from the coil 6*b* of the motor stator 6, which are the coil connecting ends 6*c*. The axes of the introduction bores 60*c* are configured to extend through the through hole 57 of the circuit case member 51. With this configuration, in the state in which the heat sink 54 is not mounted on the through hole 57 of the circuit case member 51, the connection between the introduction bores 60*c* of the circuit substrate 60 and the coil connecting ends 6*c* can be visually checked via the through hole 57 of the circuit case member 51. As a result, operability is improved.

(15) The circuit case member 51 includes the accommodating recess 53. The accommodating recess 53 is recessed in a direction away from the circuit substrate 60 to accommodate the circuit components, which include tall-height components such as the capacitors 61 and the coil 62. The heat sink 54 is arranged side-by-side with the accommodating recess 53 in a direction orthogonal to the rotary shaft 7. Thus, the size of the circuit case member 51 is prevented from being increased in the axial direction by providing the heat sink 54. This contributes to size reduction of the electric pump in the axial direction.

(16) The circuit case member 51 is formed of a flexible plastic material. Thus, the circuit case member 51 having flexibility absorbs vibration of the stator case 50. Thus, vibration is prevented from being transmitted from the motor stator 6 to the circuit substrate 60 via the circuit case member 51.

(17) The circuit substrate 60 is fixed to the circuit case member 51 by thermal staking. Thus, the circuit case member 51 and the circuit substrate 60 are fixed without using fasteners such as bolts. As a result, the structure is simplified.

The above described embodiments may be modified as follows.

According to the second embodiment, the circuit substrate 60 is fixed to the circuit case member 51 by thermal staking. However, the circuit substrate 60 may be fixed to the circuit case member 51 by bolts or an adhesive.

According to the second embodiment, the accommodating recess 53 and the heat sink 54 are arranged in proximity in the direction orthogonal to the rotary shaft 7 in the circuit case member 51. However, besides this, for example, the heat sink 54 may be located axially outward than the bottom wall 53*a* of the accommodating recess 53, that is, on the opposite side from the stator case 50.

According to the second embodiment, the circuit substrate 60 is arranged inside the large diameter portion 50*b* of the stator case 50. However, besides this, for example, the circuit substrate 60 may be arranged inside the circuit case member 51.

Types of the circuit components mounted on the circuit substrate 60 are not limited to the above-mentioned second embodiment, but may be modified as required in accordance with the configuration.

In each of the above embodiments, the electric pump is for circulating the vehicle oil. However, the electric pump may be used in other applications.

DESCRIPTION OF THE REFERENCE NUMERALS

1 . . . pump housing, 1*a* . . . shaft support hole, 1*b* . . . pump chamber recess (pump chamber component), 3, 31, 50 . . . stator case (motor case), 3*e* . . . clinch pieces configuring part of retaining structure, 4, 51 . . . circuit case member, 4*e* . . . clinch receiving portions configuring part of retaining structure. 4*g* . . . guiding and retaining grooves (guiding and retaining portions), 5 . . . heat sink cover, 5*a* . . . circuit accommodating recess, 5*b* . . . large recess, 5*c* . . . small recess, 5*d*, 54*b* . . . dissipation fins, 6 . . . motor stator, 6*c* . . . coil connecting ends (connecting portions), 7 . . . rotary shaft, 8 . . . pump rotor (pump operating portion), 9 . . . motor rotor, 21, 61 . . . capacitors (circuit components), 22, 63 . . . power transistors (circuit components), 23, 60 . . . circuit substrate, 24 . . . silicone rubber (elastic member), 53 . . . accommodating recess, 54 . . . heat sink, 57 . . . through hole, 60*c* . . . introduction bores, 62 . . . coil (circuit component), 64 . . . control IC (circuit component), P . . . pump chamber.

The invention claimed is:

1. An electric pump, comprising:

a metal pump housing including a shaft support hole for rotationally supporting a middle part of a rotary shaft and a pump chamber component, wherein the rotary shaft includes a first end on which a pump operating portion is provided and a second end on which a motor rotor is provided, and the pump chamber component is configured to define a part of the pump chamber on one end of the shaft support hole;

a metal motor case fixed to the pump housing at a side of the second end, wherein the motor case is configured to accommodate a motor section including a motor stator and the motor rotor inside the motor case;

a plastic circuit case member fixed to a part of the motor case that is opposite to the part to which the pump housing is fixed;

a circuit substrate containing a circuit component for controlling activation of the motor section; and a metal heat sink for dissipating heat of the circuit component, wherein the circuit substrate is fixed to the circuit case member and is separate from the motor case, wherein the circuit case member is arranged between the heat sink and the motor case, wherein the circuit case member includes a motor case side that is in contact with the motor case and that is facing towards the motor case in the axial direction of the rotary shaft, and an opposite side that is opposite to the motor case in the axial direction of the rotary shaft, the circuit case member retains the circuit substrate adjacent the motor case side of the circuit case member, the circuit case member further includes a through hole, which extends in the axial direction of the rotary shaft, and the heat sink is provided on the circuit case member to close the through hole, wherein the circuit substrate is located inside the motor case.

2. The electric pump according to claim 1, wherein the heat sink is located inward of the outer shape of the circuit case member as viewed in the axial direction of the rotary shaft.

3. The electric pump according to claim 1, wherein the motor stator includes a connecting portion, the circuit substrate includes an introduction bore connected to the connecting portion of the motor stator, and the axis of the introduction bore extends through the through hole of the circuit case member.

4. The electric pump according to claim 1, wherein the heat sink is a heat sink cover, and the heat sink cover and the motor case are fixed to sandwich the circuit case member, and a part of the heat sink cover close to the motor case includes a circuit accommodating recess for accommodating the circuit component.

5. The electric pump according to claim 4, wherein the motor stator includes a coil connecting end, the circuit case member includes a groove or hole for retaining the coil connecting end and guiding the coil connecting end toward the circuit accommodating recess, and the motor case and the circuit case member have a clinch piece and a receiving portion that prevents movement of the motor case and the circuit case member relative to each other.

6. The electric pump according to claim 4, wherein the circuit component includes a large circuit component and a small circuit component, and the large circuit component is larger than the small circuit component, the circuit accommodating recess includes a large recess, which is deep in the axial direction of the rotary shaft to be able to accommodate the large circuit component, and a small recess, which is shallow in the axial direction to be able to accommodate the small circuit component, and a dissipation fin is formed on the back surface of the heat sink cover that corresponds to the small recess, the dissipation fin projecting in the axial direction.

7. The electric pump according to claim 6, wherein the small circuit component includes a power transistor for controlling the motor stator, the motor stator is a stator of a brushless motor, and the small recess accommodates the power transistor.

8. The electric pump according to claim 7, wherein the power transistor is mounted on the circuit substrate, and the power transistor contacts a bottom surface of the small recess via an elastic member.

9. The electric pump according to claim 1, wherein the circuit case member is formed of a flexible plastic material.

10. The electric pump according to claim 9, wherein the circuit substrate is fixed to the circuit case member by thermal staking.

11. The electric pump according to claim 1, wherein a rotor core of the motor rotor is a laminated core formed by laminating core sheets.

12. An electric pump, comprising:

a metal pump housing including a shaft support hole for rotationally supporting a middle part of a rotary shaft and a pump chamber component, wherein the rotary shaft includes a first end on which a pump operating portion is provided and a second end on which a motor rotor is provided, and the pump chamber component is configured to define a part of the pump chamber on one end of the shaft support hole;

a metal motor case fixed to the pump housing at a side of the second end, wherein the motor case is configured to accommodate a motor section including a motor stator and the motor rotor inside the motor case;

a plastic circuit case member fixed to a part of the motor case that is opposite to the part to which the pump housing is fixed;

a circuit substrate containing a circuit component for controlling activation of the motor section; and a metal heat sink for dissipating heat of the circuit component, wherein the circuit substrate is fixed to the circuit case member and is separate from the motor case, wherein the circuit case member is arranged between the heat sink and the motor case, wherein the circuit case member includes a motor case side that is in contact with the motor case and that is facing towards the motor case in the axial direction of the rotary shaft, and an opposite side that is opposite to the motor case in the axial direction of the rotary shaft, the circuit case member retains the circuit substrate adjacent the motor case side of the circuit case member, the circuit case member further includes a through hole, which extends in the axial direction of the rotary shaft, and the heat sink is provided on the circuit case member to close the through hole, wherein the circuit case member includes an accommodating recess that recesses in a direction away from the circuit substrate to accommodate the circuit component, and the accommodating recess and the heat sink are arranged in proximity in a direction orthogonal to the rotary shaft.

13. The electric pump according to claim 12, wherein the heat sink is located inward of the outer shape of the circuit case member as viewed in the axial direction of the rotary shaft.

14. The electric pump according to claim 12, wherein the motor stator includes a connecting portion, the circuit substrate includes an introduction bore connected to the connecting portion of the motor stator, and the axis of the introduction bore extends through the through hole of the circuit case member.

* * * * *